United States Patent [19]

Sato et al.

[11] Patent Number: 4,552,610

[45] Date of Patent: Nov. 12, 1985

[54] AUTOMATIC LABEL WINDING AND CHARGING DEVICE FOR PRINTERS

[75] Inventors: Yo Sato, Tokyo; Tadao Kashiwaba; Akeshi Odajima, both of Iwate, all of Japan

[73] Assignee: Kabushiki Kaisha Sato, Japan

[21] Appl. No.: 606,698

[22] Filed: May 3, 1984

[30] Foreign Application Priority Data

May 28, 1983 [JP] Japan ..... 58-79738

[51] Int. Cl.[4] ..... B65C 11/00

[52] U.S. Cl. ..... 156/384; 101/288; 156/577; 156/579; 156/584; 156/DIG. 48

[58] Field of Search ..... 156/384, 577, 579, 584, 156/DIG. 33, DIG. 47, DIG. 48; 101/288

[56] References Cited

U.S. PATENT DOCUMENTS

| | | | |
|---|---|---|---|
| 4,377,435 | 3/1983 | Fujita | 156/384 |
| 4,436,573 | 3/1984 | Sato et al. | 101/288 |
| 4,439,257 | 3/1984 | Sato et al. | 156/577 |
| 4,440,592 | 4/1984 | Sato et al. | 156/577 |
| 4,451,323 | 5/1984 | Sato et al. | 156/577 |

*Primary Examiner*—Michael Wityshyn
*Attorney, Agent, or Firm*—Ostrolenk, Faber, Gerb & Soffe

[57] ABSTRACT

An automatic label winding and charging device is provided for use with a portable label applying system in which labels temporarily adhered in series to a web of backing paper are printed with bar codes or the like by the action of a printer. The label web having printed labels is fed to a take-up cassette that is removably mounted in the printer, being removable therefrom for insertion in a dispenser for applying the printed labels to commodities. The automatic label winding and charging device comprises a cassette guide member for guiding the cassette when the latter is to be mounted in the printer. Pressure releasing means is provided for releasing the label web so that it may be freely advanced. In order to ensure the smooth guidance of the label web, an arcuate guide groove is provided for guiding the printed label web therethrough to the cassette. A cutter is provided to sever this printed label web at a suitable position thereof.

8 Claims, 22 Drawing Figures

AUTOMATIC LABEL WINDING AND CHARGING DEVICE FOR PRINTERS

BACKGROUND OF THE INVENTION

1. Field of the Invention

The present invention relates to a portable label applying system which is equipped with a printer, a cassette for taking up a continuous web of printed labels, and a label applicator adapted to be charged with the cassette and to be manually actuated to peel the labels from their backing paper and to apply them to commodities. More particularly, this invention relates to an automatic label winding and charging device for use with the printer of such a portable label applying system.

2. Description of the Prior Art

The prior art has provided a portable type label applicator for printing on labels that are temporarily adhered in series to a web of backing paper, then peeling printed labels from the backing paper and applying them to articles such as commodities. A label applicator of this type is often referred to as a "hand labeler" and is widely used in supermarkets and the like. This hand labeler is employed mainly for applying labels to the commodities at a counter where the commodities are displayed. However, in recent years bar code labels have come into wide use, and the bar codes cannot be accurately printed by the simple type printing head mounted in an existing hand labeler so that they may fail to be correctly read out by an optical reader.

The printing head for the bar codes is necessarily larger than the printing head for the usual alpha/numeric characters because of their standardized size. As a result, the hand labeler with bar code printing capability is accordingly large-sized and too heavy for easy handling so that it augments the fatigue of its operator.

In addition, the bar codes are required to have check digits because a hand labeler finds it difficult, in size and structure, to include a function that automatically computes the check digits. As a result, the check digits have to be separately computed and set in the printing head, thus adding to operational inconvenience for the hand labeler, in this respect.

In Japanese Patent Laid-Open No. 56-210021 entitled "Portable Label Applying System", filed Dec. 28, 1981, there is disclosed a system in which a label web having its labels adhered to backing paper is printed by a desk type printer. In the letter, the label web having the printed label is wound in a cassette which is used to charge a label applicator that does not have a printer. This desk type system accurately and efficiently prints and applies the bar code labels. However, the label web has to be manually wound in the cassette that is mounted in the printer. This manual winding operation is remarkably troublesome.

SUMMARY OF THE INVENTION

Therefore, a general object of the present invention to eliminate those defects of the prior art described heretofor. Another object of the present invention is to provide an automatic label winding and charging device for use with a printer, which can automatically wind a web of printed labels upon a cassette and charge a label applicator with the cassette.

According to a feature of the present invention, there is provided an automatic label winding and charging device for use with the printer of a portable label applying system. Such a system includes a printer for printing a plurality of labels which are adhered in longitudinal series to a web of backing paper and a take-up cassette adapted to be mounted in said printer for taking up the printed label web thereon and to be demounted therefrom for dispensing and applying the printed labels to commodities, with the take-up cassette having means for holding the backing paper. The automatic label winding and charging device includes a cassette guide member for guiding the take-up cassette when the latter is to be mounted in the printer; pressure releasing means for releasing the pressure of the backing-paper holding means of the cassette; label guide means for guiding the printed label web therethrough to the cassette; and cutter means for cutting the printed label web.

BRIEF DESCRIPTION OF THE DRAWINGS

Other objects, features and advantages of the present invention will become apparent from the following description taken in conjunction with the accompanying drawings, in which.

DESCRIPTION OF THE PREFERRED EMBODIMENT

Figure 17:
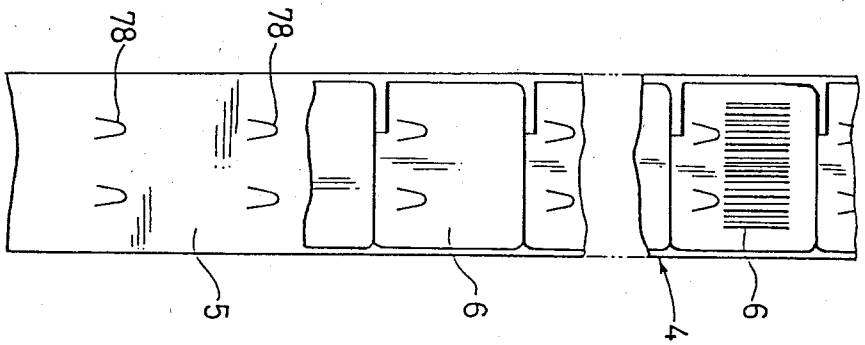
FIG. 17 is a plan view of a continuous web of labels.
Figure 18:
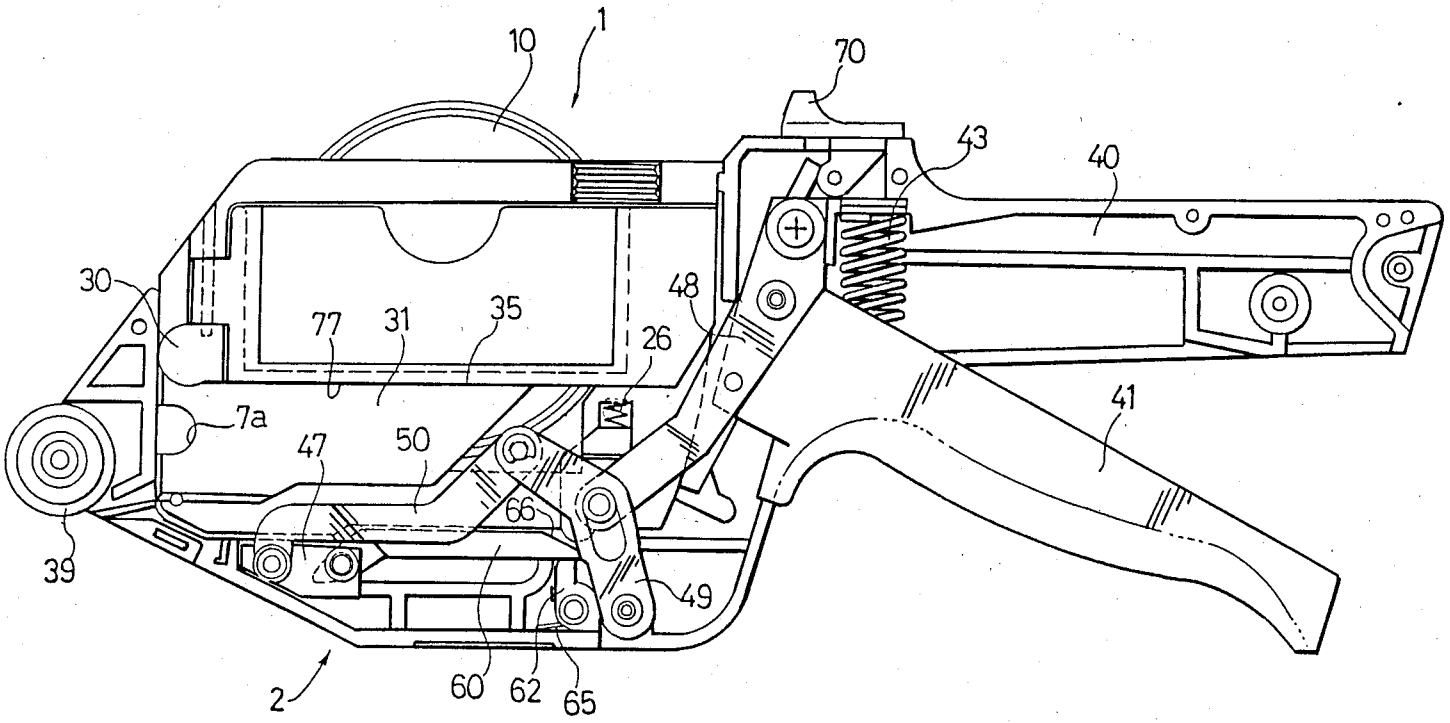
FIG. 18 is a side elevation showing the label applicator, with its near wall removed, charged with the cassette but before the applicator's hand lever is actuated.

An automatic label winding and charging device according to the present invention can be used with the printer of a portable label applying system. This system is constructed to include: a printer 3 (FIG. 10) for printing a continuous web of labels 4 (FIG. 17); a take-up cassette 1 (FIG. 1) which is made to coact with printer 3 for winding label web 4 having its labels printed by printer 3; and a label applicator 2 (FIG. 2) which is removably chargable with take-up cassette 1 and adapted to be manually actuated to feed label web 4 and to peel printed labels 6 from their backing paper 5 so that labels 6 may be applied to the outside of commodity containers, such as cans and cardboard boxes.

Figure 1:
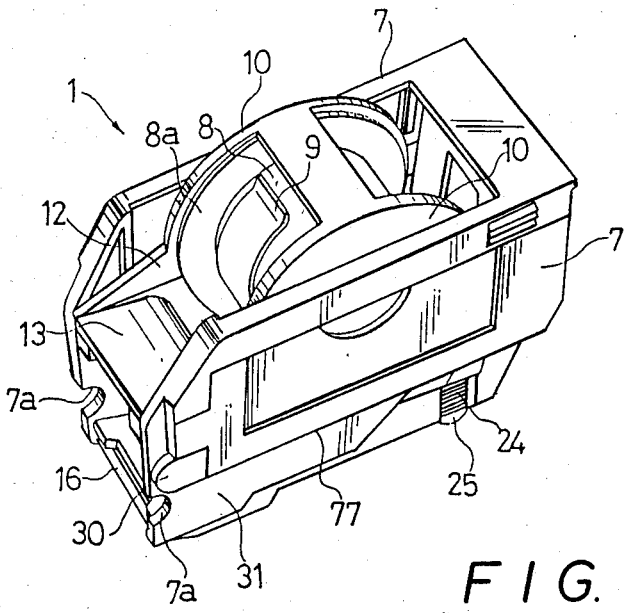
FIG. 1 is a perspective showing a take-up cassette.
Figure 4:
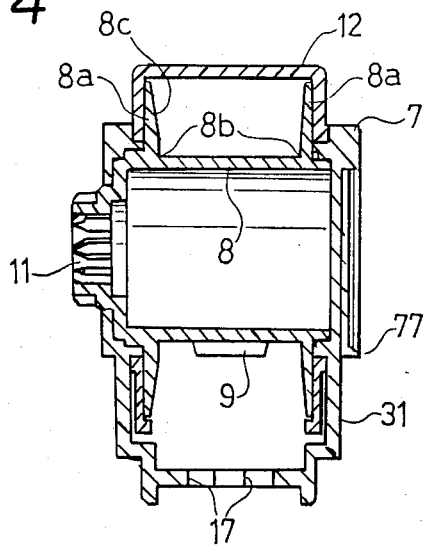
FIG. 4 is a section taken through line IV—IV of FIG. 3 looking in the direction of arrows IV—IV.

As shown in FIGS. 1 and 4, cylindrical take-up core 8 is rotatably mounted in the central portion of frame 7 of take-up cassette 1, and includes two flanges 8*a* disposed at opposite ends of straight core body 8*b*. The length of body 8*b* is slightly less than the width of label web 4. A winding space 8*c* defined by the flanges 8*a* and the core body 8*b* is expanded or countertapered in the radially outward direction. Moreover, take-up core 8 is formed at its center with boss 11 to which a rotary shaft (to be described herinafter) of printer 3 is to be fitted. Indicated by numeral 12 is a rotary member which has both its side plates formed at their rear portions with flanges 10 and at their front ends with curved label holding portion 13 which merges into the two side plates. Rotary member 12 is equipped with a guide leaf spring 9 wound around the take-up core 8, and having one end fixed on the outer circumference edges between the flanges 10 and 10 and its other end contacting with the outer circumference of the take-up core 8.

Figure 3:
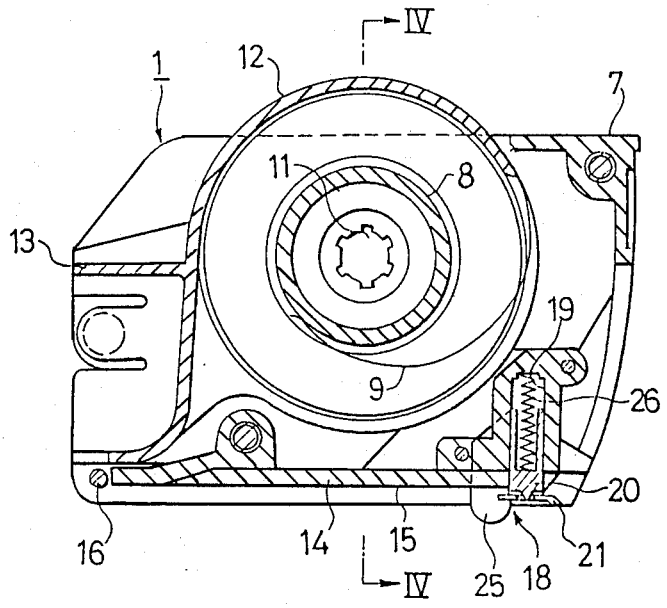
FIG. 3 is a longitudinally sectionalized side elevation showing the cassette of FIG. 1 with its rotary member closed.
Figure 7:
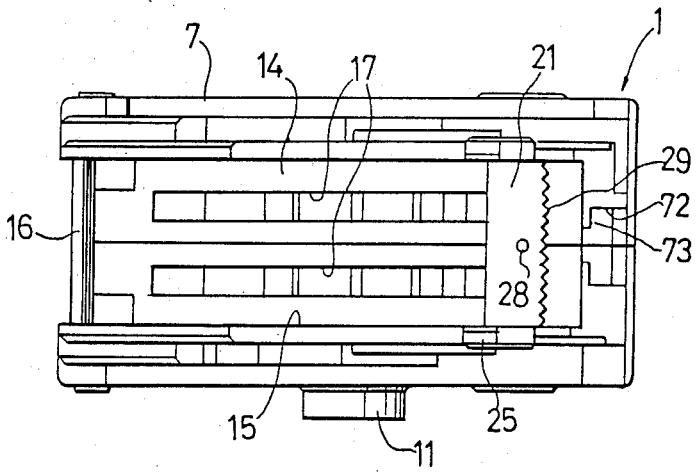
FIG. 7 is a bottom view of the cassette.

The bottom of take-up cassette 1 is covered by bottom plate 14 which is formed with backing paper guide groove 15 (FIG. 3) extending longitudinally from the front end to the rear end of bottom plate 14. The latter is also formed with a pair of pawl guides 17 extending in the longitudinal direction, as shown in FIGS. 4 and 7. Indicated by numeral 16 is a turning pin which is attached to the front of bottom plate 14 so as to rotate for advancing backing paper 5. Indicated generally by numeral 18 is a backing paper holding mechanism which is disposed at the rear of bottom plate 14.

Figure 5:
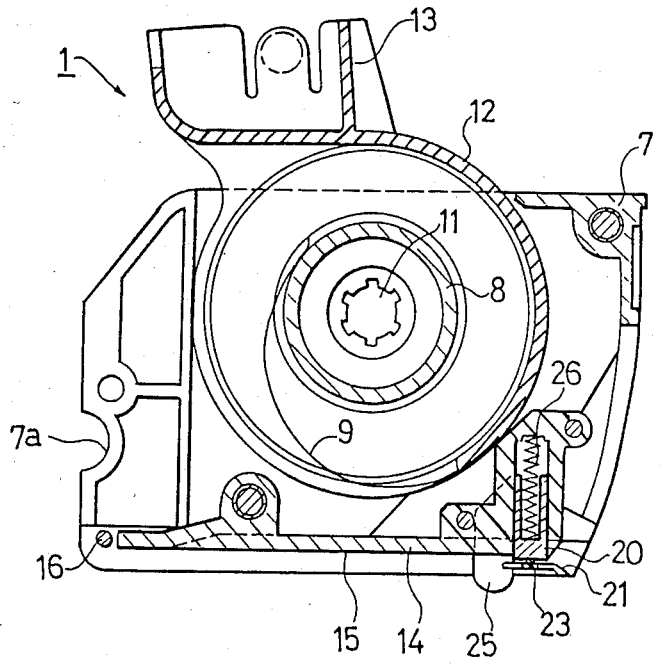
FIG. 5 is a longitudinally sectionalized side elevation showing the cassette of FIG. 1 with its rotary member turned to a loading position.
Figure 6:
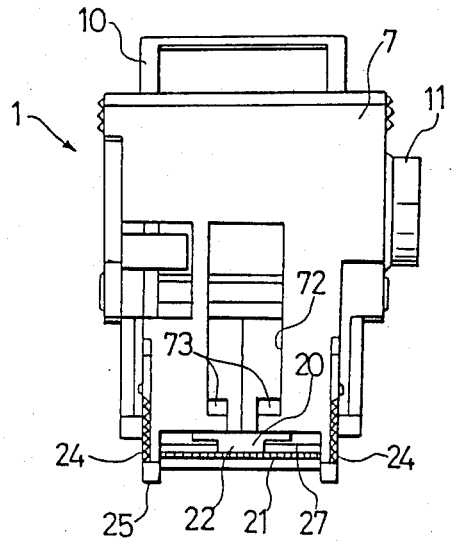
FIG. 6 is a rear elevation showing of the cassette.

Backing paper holding mechanism 18 includes pressure member 20 which is vertically movably guided by hole 19 formed in frame 7, and also includes receiving plate 21 mounted in fixed position to frame 7 at the rear end of backing paper guide groove 15. As seen in FIG. 6, the bottom of pressure member 20 is formed with pressure land 22 having its lower face at the center thereof protruding to form needle 23 (FIG. 5). Both sides of pressure member 20 are formed with integral knobs 24 which in turn are formed at their lower portions with semicircular engagement tongues 25. Coiled compression spring 26 fitted in hole 19 biases pressure member 20 downward so that engagement tongues 25 usually protrude from the bottom face of take-up cassette 1, and the pressure land 22 abuts the upper face of receiving plate 21. The latter is attached to the bottom plate 14 in an operative position defining gap 27 that is proportioned to allow passage of backing paper 5 therethrough. The center of receiving plate 14 is provided with through hole 28 for receiving needle 23 of pressure member 20, and at its rear edge plate 14 is provied with backing paper cutter 29, (FIG. 7).

Turning to FIG. 1, take-up cassette 1 is formed at the front ends of both its sides with semicircular engagement projections 30 and the lower sections of these sides are slightly recessed to form mounting portions 31 at which take-up cassette 1 is to be mounted in the label applicator 2. Moreover, the leading end of the cassette 1 at opposite side edges thereof is provided with notches 7*a* for preventing cassette 1, when in the printer 3, from being set erroneously with rotary member 12 left unraised.

Figure 2:
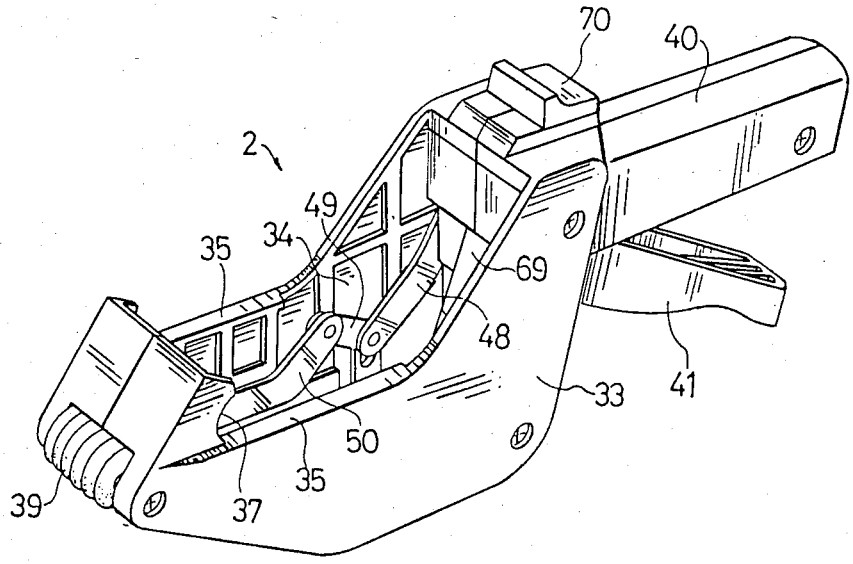
FIG. 2 is a perspective showing a label applicator.
Figure 8:
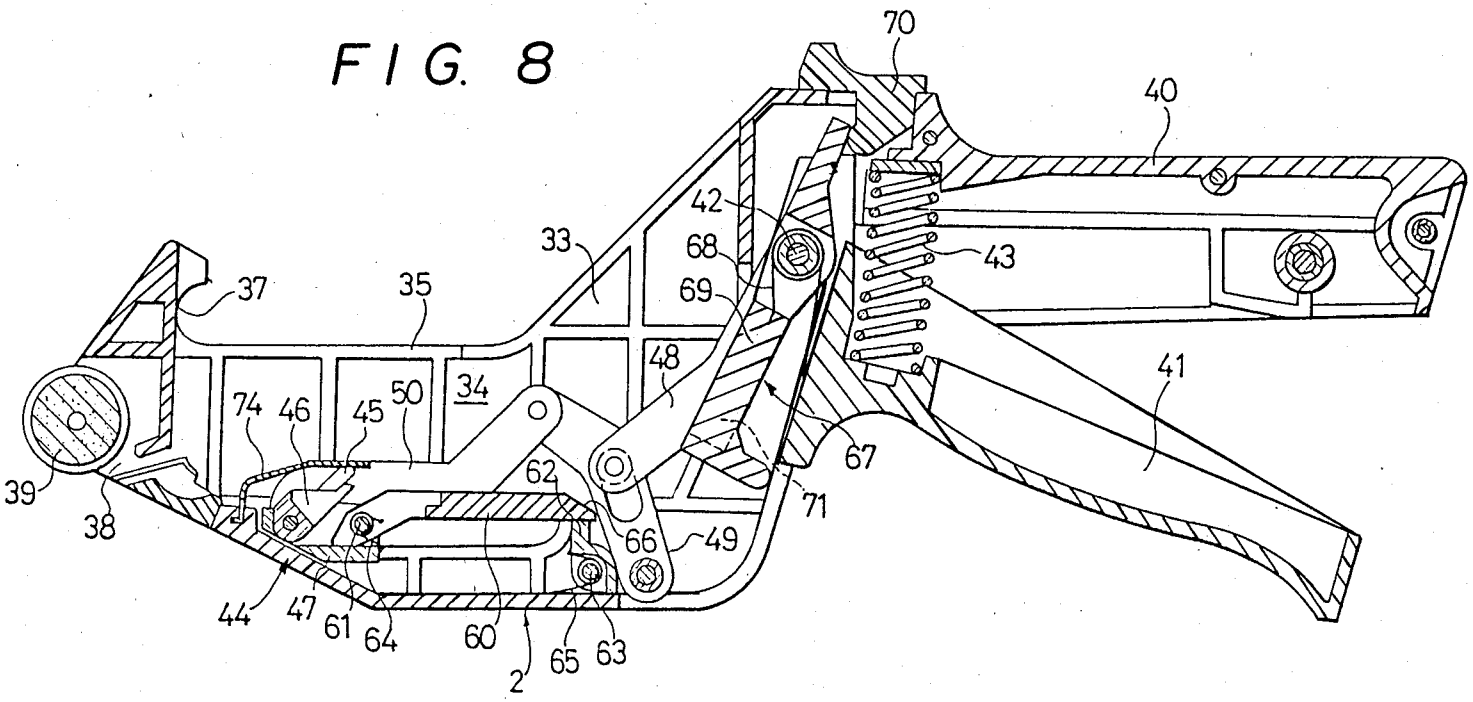
FIG. 8 is a longitudinally sectionalized side elevation showing a label applicator.
Figure 9:
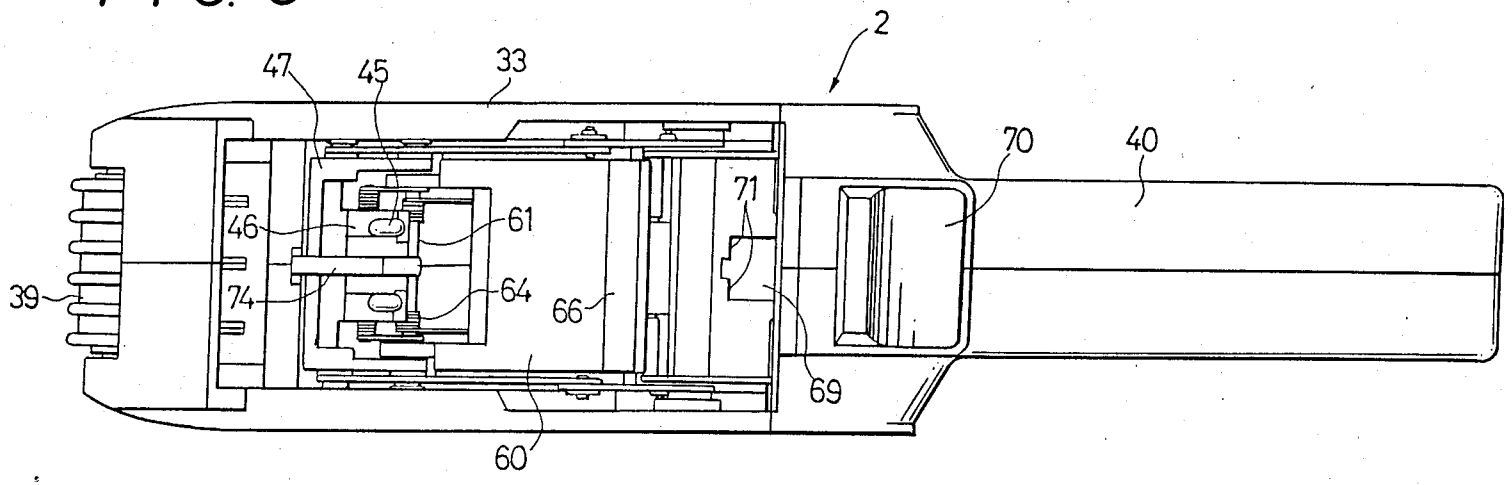
FIG. 9 is a plan view showing the label applicator.

The following description of the label applicator 2, making particular reference to FIGS. 2, 8 and 9, is brief and schematic because applicator 2 does not constitute the gist of the present invention and is of the same construction as the label applicator of aforesaid Japanese Patent Laid-Open No. 56-210021. That is, and above an applicator frame 33, there is formed space 34 to receive take-up cassette 1. The upper flat edges frame 33 are formed with ledges 35. Indicated by numeral 37 are a pair of engagement notches that receive engagement projections 30 of cassette 1. Indicated by numeral 39 is a label applying roller, having label exit 38 therebelow. The rear of applicator frame 33 extends into grip 40 disposed above lever 41. The front end of lever 41 is hinged at 42 to frame 33. Indicated by numeral 43 is a return spring that biases hand lever 41 clockwise about hinge 42. Indicated generally by numeral 44 is a feed mechanism for feeding or advancing backing paper 5. This mechanism 44 includes pawl member 46 having advanced pawls 45, holding frame 47, and first, second and third links 48, 49 and 50 for moving holding frame 47 back and forth. Push-up plate 60 is hinged to holding frame 47 by means of pin 61 mounted across frame 47 near the rear thereof. Indicated by numeral 62 is a supporting member which is hinged to frame 33 on pin 63 mounted across the frame 33. Torsion springs 64 and 65 bias push-up plate 60 and supporting member 62, respectively, counter-clockwise and clockwise with respect to FIG. 8. Moreover, the upper face of push-up plate 60 near the rear thereof is formed with a downhill portion 66. Indicated by numeral 67 is a lock mechanism for releasably locking cassette 1 in applicator 2. This lock mechanism 67 includes lock member 69 biased clockwise by the action of torsion spring 68, and manually operable demounting button 70 for moving lock member 69 counter-clockwise. When label applicator 2 is to be charged with the cassette 1, lower end corner 71 of lock member 69 is engaged by engagement projections 73 (FIGS. 6 & 7) at the lower end of opening 72 formed in the rear face of cassette 1 so as to lock cassette 1 to applicator 2. Numeral 74 (FIG. 8) indicates a backing paper holding member.

Figure 10:
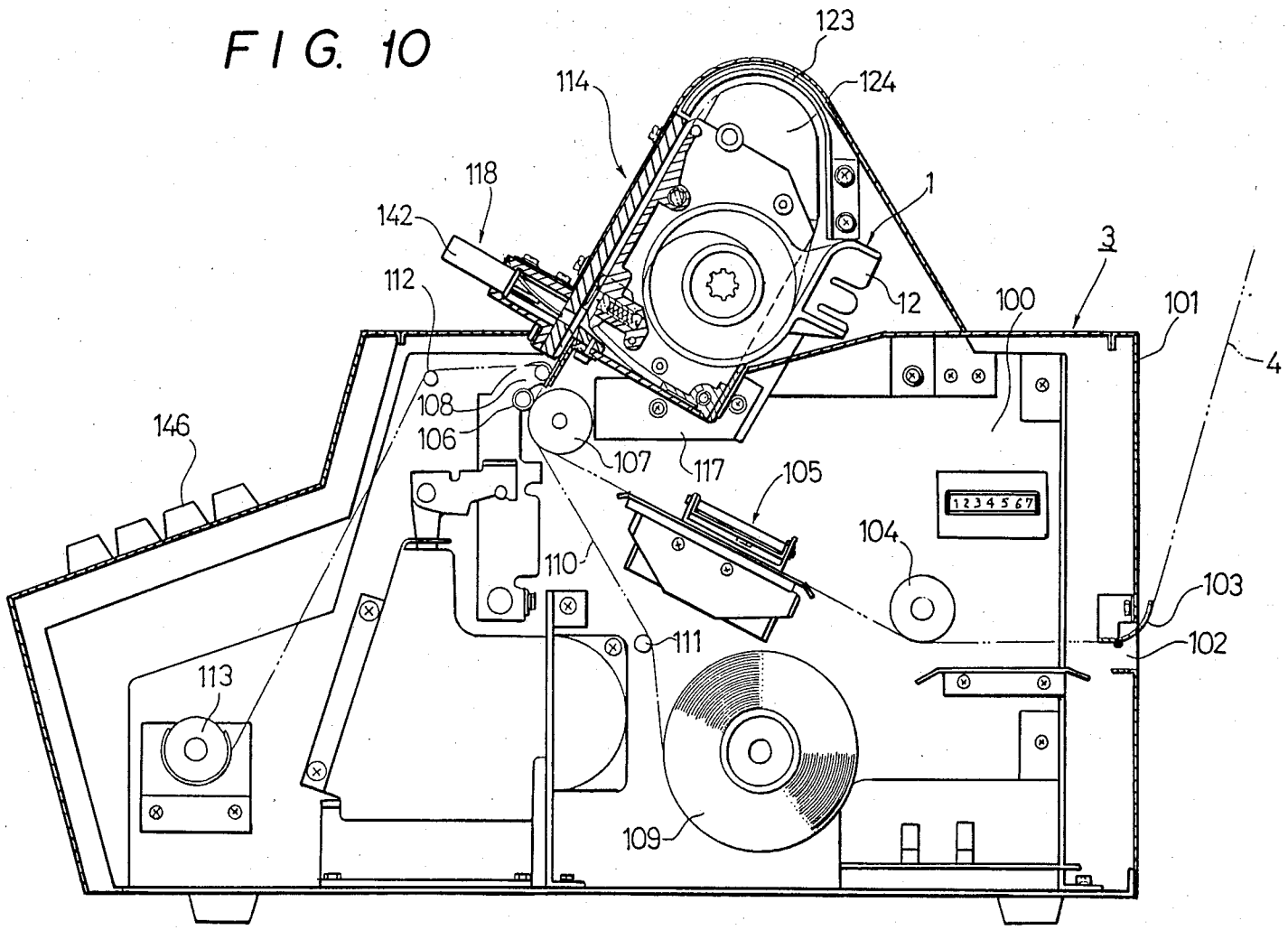
FIG. 10 is a partially and longitudinally sectionalized side elevation showing a printer which has its righthand cover removed and its mounting device charged with the cassette of FIG. 1.

Turning now to FIG. 10 that is a righthand side elevation of the printer 3, from which the let-off or supply reel for label web 4 is omitted. Numeral 100 indicates a frame counter and number 146 indicates a keyboard for inputting data to printer 3. Rear cover 101 for the printer housing is formed generally at its center with entrance 102 for receiving therethrough label web 4 which is unrolled from a let-off reel (not shown). Label web 4, having been guided by curved guide member 103 at label entrance 102, is introduced into printer 3 and is guided by guide roller 104 to advance through position detecting mechanism 105, in which the position of each label on web 4 is detected by detecting means such as a photo-sensor (not shown). The label whose position has been detected by the mechanism 105 advances between heat transfer type thermal head 106 of platen 107 which cooperate to form a thermal printer. Thermal head 106 is attached to one side of arm 108 near its free end and is so constructed that it is urged toward the platen 107 by the action of a spring (not shown). Reference numeral 109 indicates a supply or let-off reel on which a heat transfer ink ribbon 110 is wound. The latter is unwound from the reel 109 and guided by a guide roller 111 to thermal head 106, where ribbon 110 is superposed upon label web 4 before printing so that predetermined bar codes are transferred onto the labels by the action of thermal head 106. After this transfer, ink ribbon 110 is guided by guide pin 112 until it is taken up on take-up reel 113. In this meanwhile, the label web 4, having its labels bearing the transferred bar codes, is turned by platen 107 until web 4 is guided into the cassette 1 which is removably mounted on frame 100.

Mounting mechanism 114 for mounting cassette 1 in printer 3 will be described in detail with reference to FIGS. 10 to 16. Guide member 117 fixedly mounted on printer frame 100 is formed with two guide faces 115 and 116 intersecting at a right angle for locating two sides of take-up cassette 1. The left end of guide face 116 (FIG. 11) extends downward obliquely to the vicinity of the platen 107 and thermal head 106 to provide a guide portion for label web 4. Stationary knife 119 of cutter mechanism 118 (to be described hereinafter) is secured to the left end of guide face 116. Disposed generally at the middle of the upward extension of the frame 100, is head 122 of rotary shaft 121 (FIG. 14) which is to be fitted in boss 11 of take-up core 8 for cassette 1. Relatively large diameter curved guide member 123 is disposed at the upward leading end of frame 100. Guide member 123 is fixed to frame 100 and has its leading end extending to the vicinity of the upper end of the opening in the leading end of cassette frame 7. Peel preventing member 124 inside of the guide member is disposed. Member 124 is formed as a block having curved side edge having a profile that cooperates with guide member 123 to define curved guide groove 125 therebetween. In order to clean guide groove 125 and to prevent the same from being jammed with labels, one of guide member 123 and peel preventing member 124 is removable. The side edge of peel preventing member 124 away from guide member 123 is shaped to complement the leading side edge of cassette 1 and is formed at its mid-region with pin 126 which is anchored at the frame 100 and is to be fitted in the notches 7*a* at the leading end of the cassette 1. Peel preventing member 124 is of a large radius to prevent labels from being peeled off their backing paper if label web is guided in an acutely bent shape.

Figure 11:
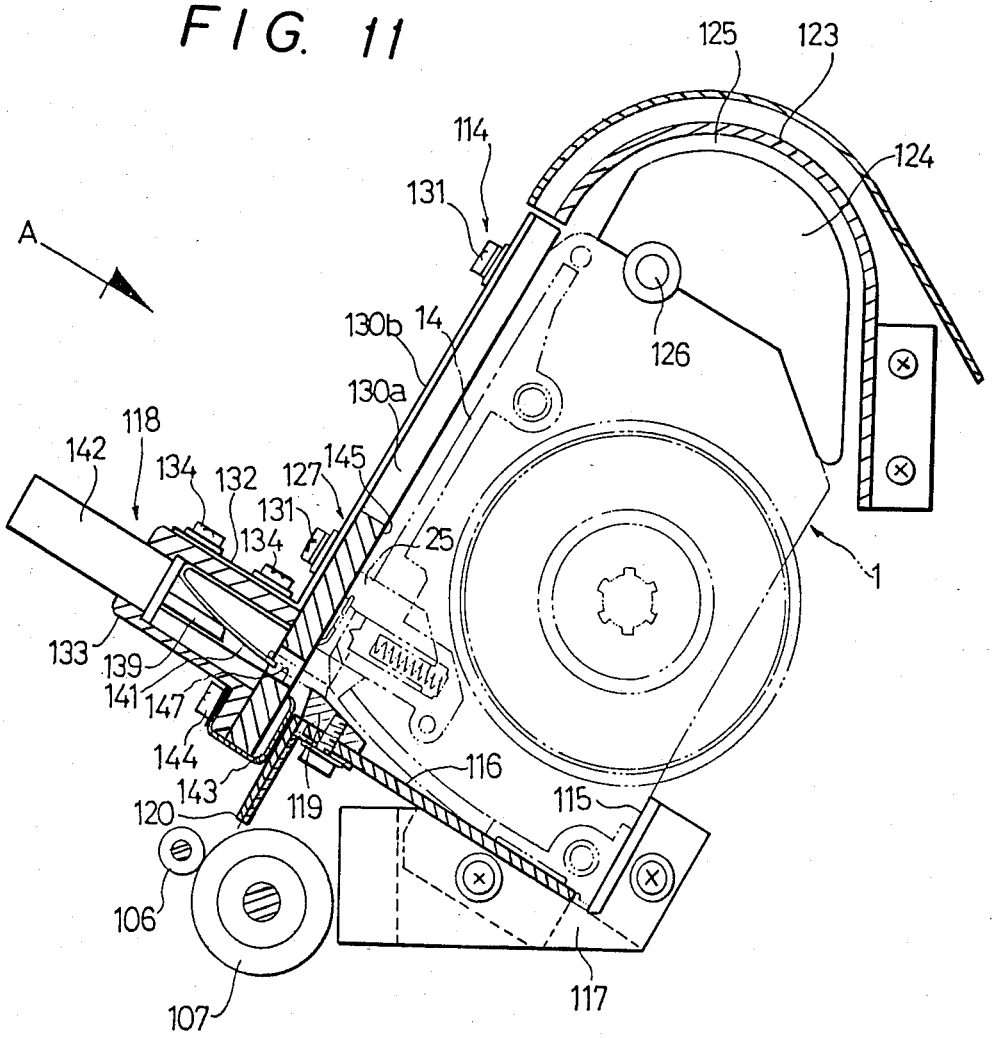
FIG. 11 is an enlarged partially and longitudinally sectionalized side elevation showing the mounting device of FIG. 10.
Figure 12:
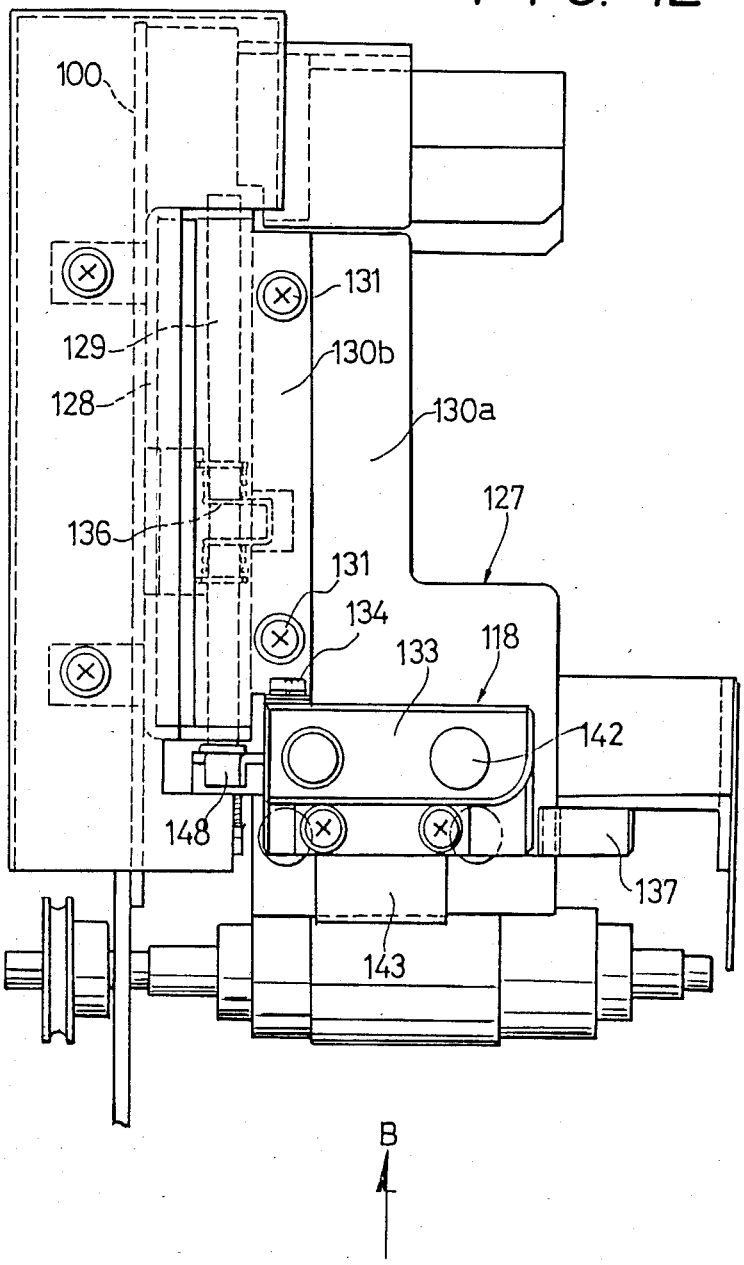
FIG. 12 is an elevation of the mounting device looking in the direction of arrow A in FIG. 11.
Figure 13:
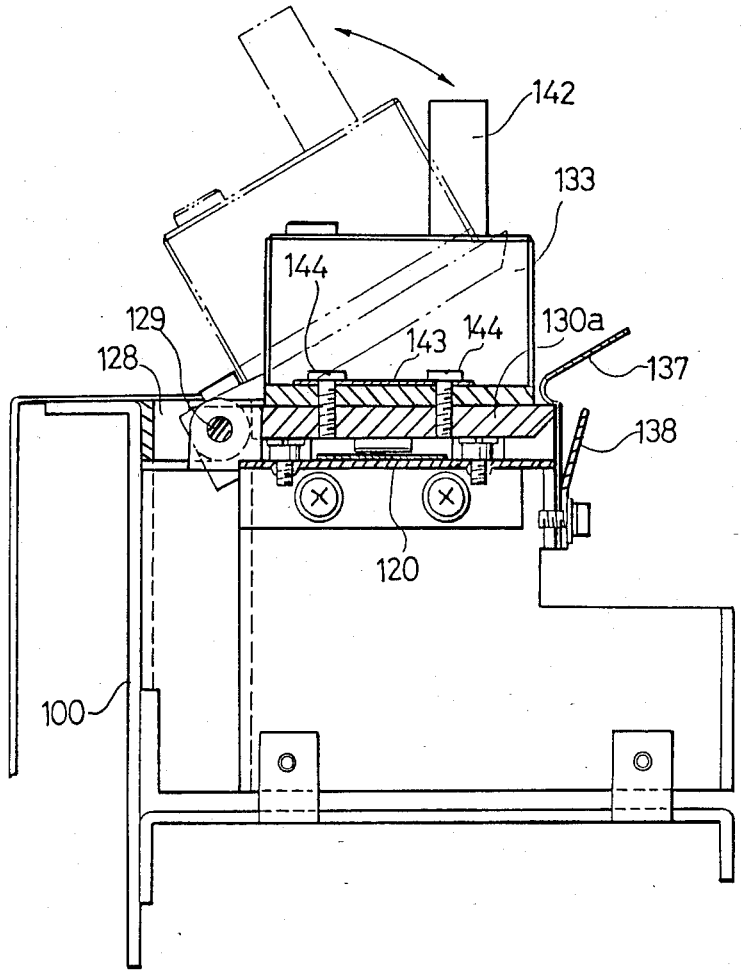
FIG. 13 is a partially sectionalized elevation of the mounting device looking in the direction of arrow B in FIG. 12.
Figure 15:
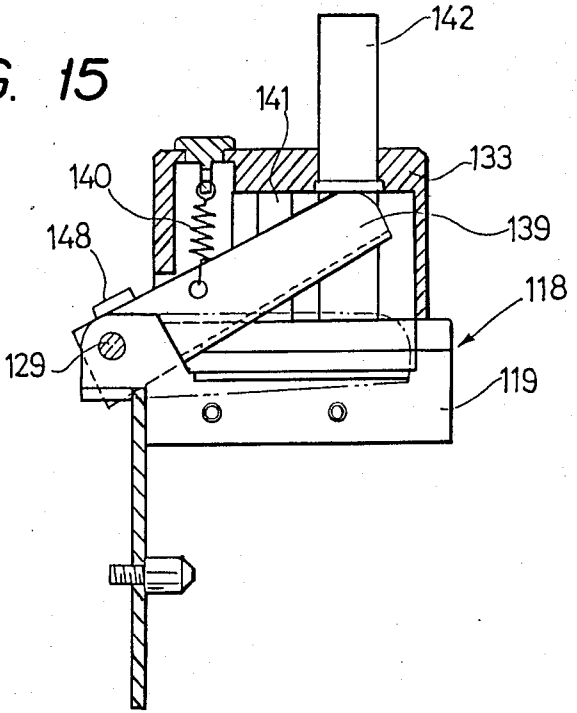
FIG. 15 is a partially and longitudinally sectionalized side elevation of a cutter mechanism.
Figure 16:
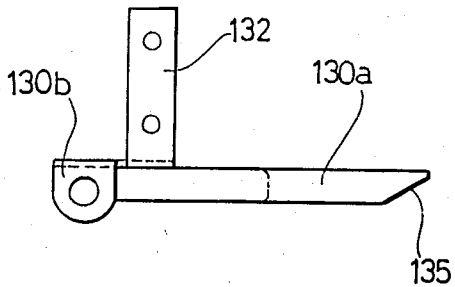
FIG. 16 is a side elevation of doors and a mounting member.
Figure 14:
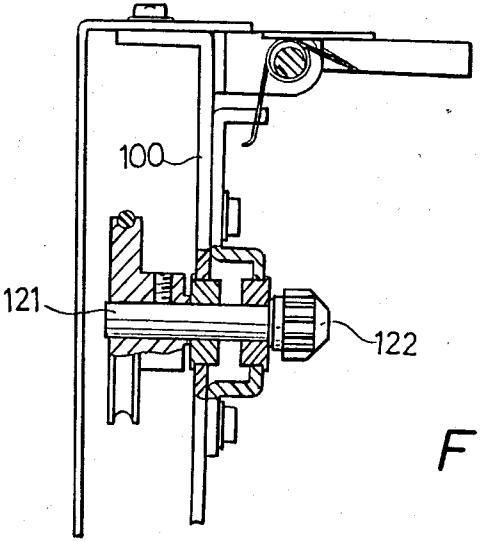
FIG. 14 is a partially and longitudinally sectionalized side elevation showing the rotary shaft and shaft head of the mounting device.

Cutter mechanism 118 and pressure releasing member 127 for releasing the pressure of backing paper holding mechanism 18 of the take-up cassette 1 will now be described with particular reference to FIGS. 11 and 12. C-shaped supporting member 128 is fixed to printer frame 100. Hinging pin 129 is inserted through the supporting member 128. Doors 130*a* and 130*b* act together as the pressure releasing member 127 and are fixedly integrated by means of stop screws 131, 131. Door 130*b* has its lefthand end so hinged that it can turn on the pin 129 in the direction of the arrows in FIG. 13. As seen in FIGS. 11 and 16, door 130*b* has its one end bent at a right angle to form mounting portion 132 and is fastened by means of screws 134 to cutter box 133 of cutter mechanism 118, which is fixed to door 130*a*. One end of the latter is chamferred into sloped face 135.

Indicated by numeral 136 is a torsion spring for biasing doors 130*a* and 130*b* counter-clockwise on hinging pin 129. Preferably, door 130*a* is constructed of a transparent plastic material so that the passage of label web 4 can be observed therethrough. When doors 130*a* and 130*b* are brought to the position shown by solid lines in FIG. 13, engagement spring 137 acts to prevent doors 130*a* and 130*b* from being opened erroneously. Indicated by numeral 138 is a stopper for preventing any permanent strain from occuring in engagement spring 137 due to excessive bending thereof when doors 130*a* and 130*b* are opened by flexing engagement spring 137 clockwise. With doors 130*a* and 130*b* in the position of FIG. 13, door 130*a* is positioned to contact and push against the leading ends of engagement tongues 25 at the sides of take-up cassette 1 (FIG. 11).

Cutter mechanism 118 (FIG. 15) is constructed to cut label web 4 through coaction of stationary knife 119 and movable knife or cutter 139, the latter being pivotably mounted on hinging pin 129. In the cutter box or housing 133, there are mounted both tension spring 140 for biasing the cutter 139 counter-clockwise and leaf spring 141 (FIG. 11) for elastically urging the cutter 139 toward contact with stationary knife 119. One end of spring extends from box 133 through aperature 147 in door 130*a*. Manually depressible button 142 projecting from box 133 to operable to move cutter 139 against the biasing force of tension spring 140. Stopper formation 148 on cutter 139 limits movement of cutter 139 under the influence of spring 140.

Label guide 143 (FIG. 11) is fastened to cutter box 133 at door 130*a* by means of screws 144. Guide portion 120 and label guide 143 cooperate to form a small gap therebetween for web 4 to pass therethrough.

Operations of the apparatus thus far described will now be explained. When engagement spring 137 deflected clockwise with respect to FIG. 13, spring 137 is released from engagement with the door 130*a*, thereby permitting the biasing force of spring 136 to move doors 130*a* and 130*b* open or counter-clockwise with respect to FIG. 13. Empty take-up cassette 1 is then mounted along guide faces 115 and 116 of the guide member 117, and boss 11 is brought into engagement with head 122 of rotary shaft 121. At the same time, notches 7*a* of cassette 1 are brought into engagement with pin 126.

At this time rotary member 12 of take-up cassette 1 is turned clockwise, as shown in FIG. 10, until it is opened. If cassette 1 is to be mounted with the rotary member 12 being left closed, label holding portion 13 of rotary member 12 comes into abutment against the pin 126 and peel preventing member 124 so that cassette 1 cannot be mounted on frame 100.

Next, when doors 130*a* and 130*b* are turned clockwise, they are retained closed by engagement with spring 137. At this time, i.e., when the doors 130*a* and 130*b* are retained by engagement spring 137, engagement tongues 25 at the lower ends of knobs 24 of take-up cassette 1 are pressed by the pressure face 145 of the inner wall of the door 130*a*. By this pressure, pressure member 20 is depressed or retracted against the elastic force of spring 26 so that needle 23 is separated from backing paper guide groove 15. In other words, backing paper holding mechanism 18 is released by presure releasing member 127 without obstructing the passage of label web 4 between door 130*a* and the bottom plate 14 of cassette 1.

After take-up cassette 1 is mounted in the predetermined position on frame 100 of printer 3 in this manner described previously, the bar codes (not shown) to be printed are inputted by using keyboard 146 of printer 3. At this time label web 4, having unprinted labels adhered thereto, is pulled from a let-off reel (not shown). This label is threaded along guide member 103 and guide roller 104 into the position detecting mechanism 105, is turned along the platen 107, and the leading end of label web 4 is threaded into the gap between guide portion 120 and label guide 143 until it is introduced into the gap between door 130*a* and bottom plate 14. Heat transfer ink ribbon 110 is also pulled out of reel 109, being threaded along guide roller 111 and between thermal head 106 and the label web 4 until the leading end of ribbon 110 is taken up by take-up reel 113 through guide pin 112. By depressing the start key of keyboard 146, a motor (not shown) is energized to turn rotary shaft 121 so that take-up core 8 starts its rotations through boss 11 of cassette 1, in which head 122 of the shaft 121 is fitted. At the same time, platen 107, take-up reel 113 and other rotatable elements on printer 3 are started so that thermal head 106 is operated to begin a printing bar codes in response to set printing instructions. Continuous label web 4 having bar codes heat-transferred to its labels is advanced continuously or consecutively intermittently through backing paper guide groove 15 between door 130*a* and bottom plate 14 of cassette 1. Label web 4, having left backing paper guide groove 14, is advanced along guide member 123 to cassette 1 by way of the guide groove 125 that extends between guide member 123 and peel preventing member 124. Since, at this time, the rotary member 12 of cassette 1 is opened, as shown in FIGS. 5 and 10, label web 4 is guided along the lower side of the label holding portion 13 into winding space 8*c* defined by rotary member 12 and take-up core 8. Since winding space 8*c* is counter-tapered by the inner faces of flanges 8*a*, 8*a* of take-up core 8, label web 4 is guided for a while between flanges 8*a*, 8*a* without being dragged by their inner faces. Before long, label web 4 is guided along guide spring 9 to take-up core 8 until it is thrust onto take-up core 8 by the leading end of guide plate 9. At this time both side edges of label 4 contact straight core body 8*b* at the legs of flanges 8*a* and 8*a*. Since the length of straight core body 8*b* is slightly less than the width of label web 4, the latter has both its side edges restricted when it is pushed onto take-up core 8 by guide spring 9, so that label web 4 is wound or taken up sequentially as take-up core 8 is turned. When a predetermined quantity of the continuous label web 4 is wound on core 8, the motor (not shown) driving shaft 121 is stopped as is the drive for the supply or let-off of label web 4.

After that, button 142 of cutter mechanism 118 is depressed to turn cutter 139 clockwise against the biasing force of tension spring 140. By so doing, cutter 139 passes through aperature 147 in door 130*a* and drops into cooperation with stationary knife 119 to cut label web 4.

Thus, cassette 1, loaded with label web 4 having bar codes printed theron, is dismounted from mounting device 114 of the printer 3. For this cassette demounting operation, engagement spring 137 is deflected clockwise thereby permitting doors 130*a* and 130*b* to pivot counter-clockwise. Label web 4 may then be pulled out of guide groove 125 by grasping cassette 1. At this time, label web 4 left in guide groove 125 is in condition to protrude in a semicircular shape from the cassette 1. In this state, boss 11 of cassette 1 is turned by hand to take up the extension of label web 4 on take-up core 8. Then, rotary member 12 is returned to the locked state shown in FIG. 1 to complete the charging of cassette 1 with label web 4.

In the foregoing description, cassette 1 is neither mounted in nor demounted from mounting device 114 of printer 3 before doors 130*a* and 130*b* are opened. However, mounting and demounting of cassette 1 can be conducted even with doors 130*a* and 130*b* being left closed. That is, since door 130*a* is formed with sloped face 135, (FIG. 16), engagement tongues 25 at the lower ends of knobs 24 are pressed by the sloped face 135 when cassette 1 is mounted along guide faces 115 and 116 of guide member 117, until tongues 25 come into contact with pressure face 145 on the inner wall of the door 130*a* so that needle 23 separates from backing paper guide groove 15, as has been described hereinbefore.

Moreover, the embodiment that has been described is constructed such that guide member 117, having guide faces 115 and 116, is used as the guide means when cassette 1 is mounted in mounting device 114. The present invention should not be limited to the aforementioned embodiment but may be modified such that the cassette 1 is formed with at least two through holes whereas mounting device 114 is formed with two pins which are anchored at the positions corresponding to those through holes so that cassette 1 may be guided by both the through holes and the pins.

The following description is for the situation in which take-up cassette 1 is to be mounted in or demounted from label applicator 2. This situation will be described simply and schematically because it is not the gist of the present invention, but has been described in detail in the specification of the aforementioned Japanese Patent Laid-Open No. 56-210021. Specifically, mounting portions 31 of cassette 1 are accommodated in space 34 of applicator 2 such that engagement projections 30 at the leading end of the cassette 1 are held in contact with engagement notches 37 of applicator 2. At this time, the pent-roofs or shoulders 77 of the cassette 1 are placed on ledges 35 of applicator 2 so that cassette 1 is automatically locked by lock mechanism 67. More specifically, the lower end 71 of lock member 69 comes into engagement with and is locked by engagement projections 73. If hand lever 41 is then squeezed, holding frame 47 is horizontally moved back along guide grooves 57 through the action of first, second and third links 48, 49 and 50. During this horizontal movement, the advancing pawls 45 of pawl member 46 engage with cuts 78 formed at predetermined intervals in backing paper 5 (FIG. 17) to advance backing paper 5.

Figure 19:
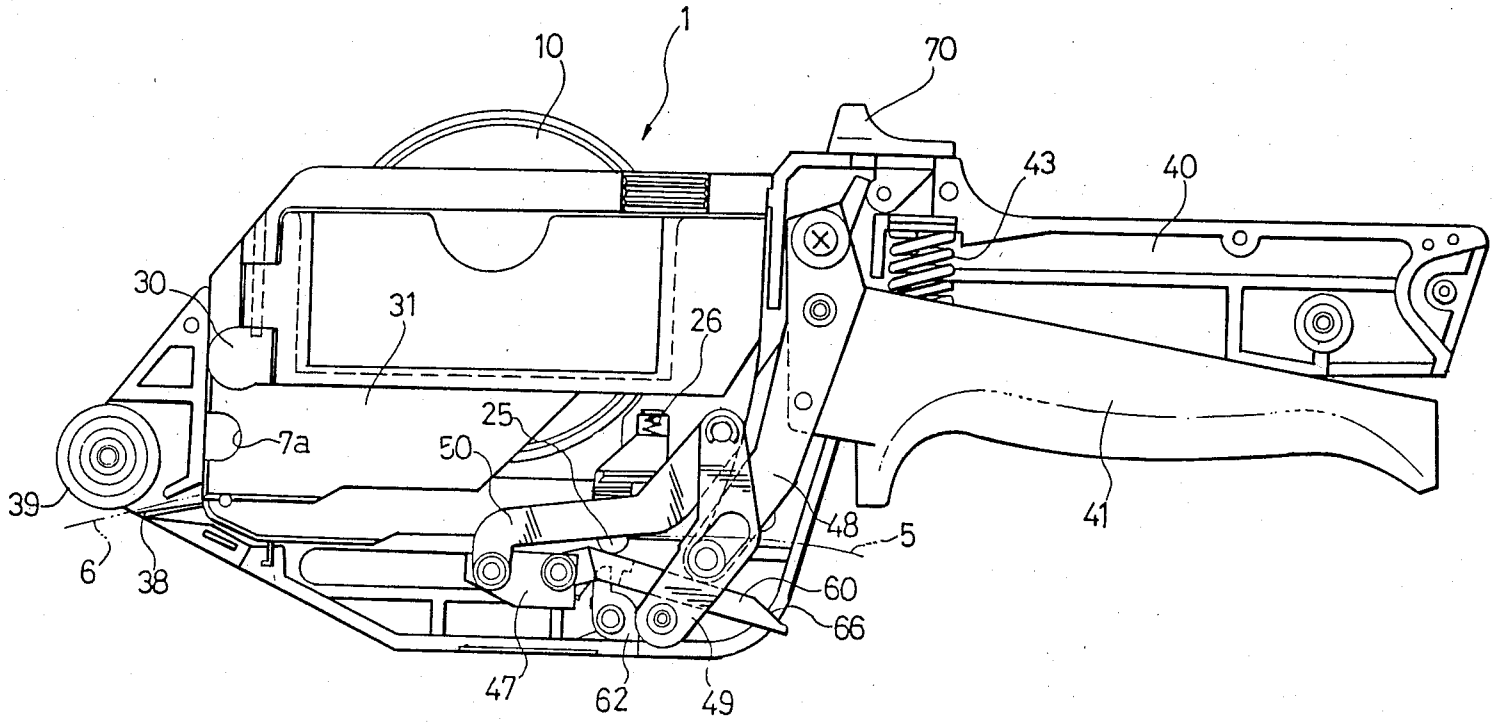
FIG. 19 is a side elevation of the elements of FIG. 18 with the hand lever fully squeezed.

Push-up plate 60 is also moved to push up engagement tongue 25 of pressure member 20. As a result, backing paper 5 is released from pressure land 22 and needle 23 of the pressure member 20 so that backing paper 5 is smoothly fed back until it is discharged to the outside of label applicator 2. If hand lever 41 is squeezed further, as shown in FIG. 19, push-up plate 60 is retracted to disengage its lower face from supporting member 62. As a result, pressure member 20 is moved down to restore its original position so that backing paper 5 is held again by the coactions of pressure land 22 and needle 23. During this backing paper feeding operation, only backing paper 5 of label web 4 is turned at an acute angle by the turning pin 16 at the front end of cassette 1 so that labels 6 are peeled from backing paper 5 and allowed to advance until they are fed through label exit 38 down to label applying roller 39. The peeled labels 6 are conducted by the actions of roller 39, in a conventional hand labeler, with the lower (or adhesive) side of label 6 just below applying roller 39 being rubbed on or applied to a commodity. If hand lever 41 is then released, it is returned to its original position by the action of return spring 43, and holding frame 47 is returned forward to its original position by the first to third links 48 and 50. During this forward movement of frame 47, pushup plate 60 is set to advance while sliding on the lower faces of tongues 25 without raising the latter. As a result, backing paper 5 is fixed by pressure member 20 and is not pulled forward by the forward motion of pawl member 46. Then, advancing pawls 45 of pawl member 46 become disengaged from cuts 78 of backing paper 5 to slide on the lower side backing paper 5 until restored to its original position, in which it engages again with the cuts 78 of the backing paper 5.

In order to demount take-up cassette 1 from label applicator 2, demounting button 70 is pushed forward and lock member 69 is turned counter-clockwise to disengage its lower end corner 71 from engagement pojections 73 of cassette 1. This permits rear portion of the cassette 1 to slightly pop up by the spring action of backing paper hold member 74, which presses the lower side of the backing paper 5 in front of the backing paper guide groove 15, to raise the rear of cassette 1 slightly so that cassette 1 can be easily removed from applictor 2.

Since label web 4 having its labels 6 printed with bar codes can be automatically wound over a predetermined length merely by charging printer 3 with cassette 1, the troublesome work of winding labels 6 in cassette 1 is eliminated to ensure efficient operations. Moreover, the operation of mounting cassette 1 in printer 2 can be conducted by the single action of actuating actuating lever 41, and labels 6 are not peeled off while label web 4 is being taken up, because printer 3 is equipped with the peel preventing member 124.

Figure 20:
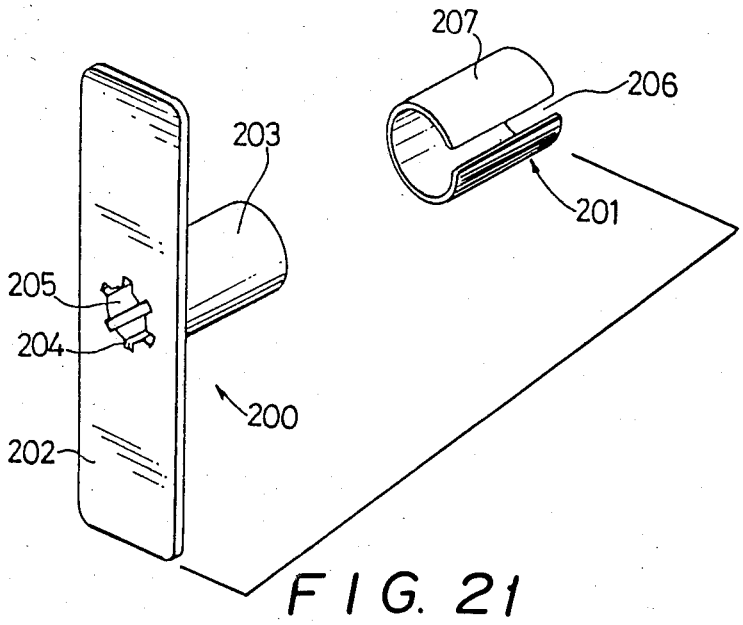
FIG. 20 is an exploded perspective showing an adaptor and a take-up tool.
Figure 21:
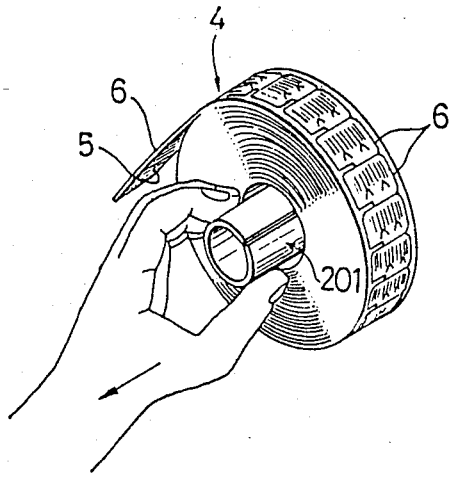
FIG. 21 is a perspective of a take-up tool with a continuous label web wound thereon.
Figure 22:
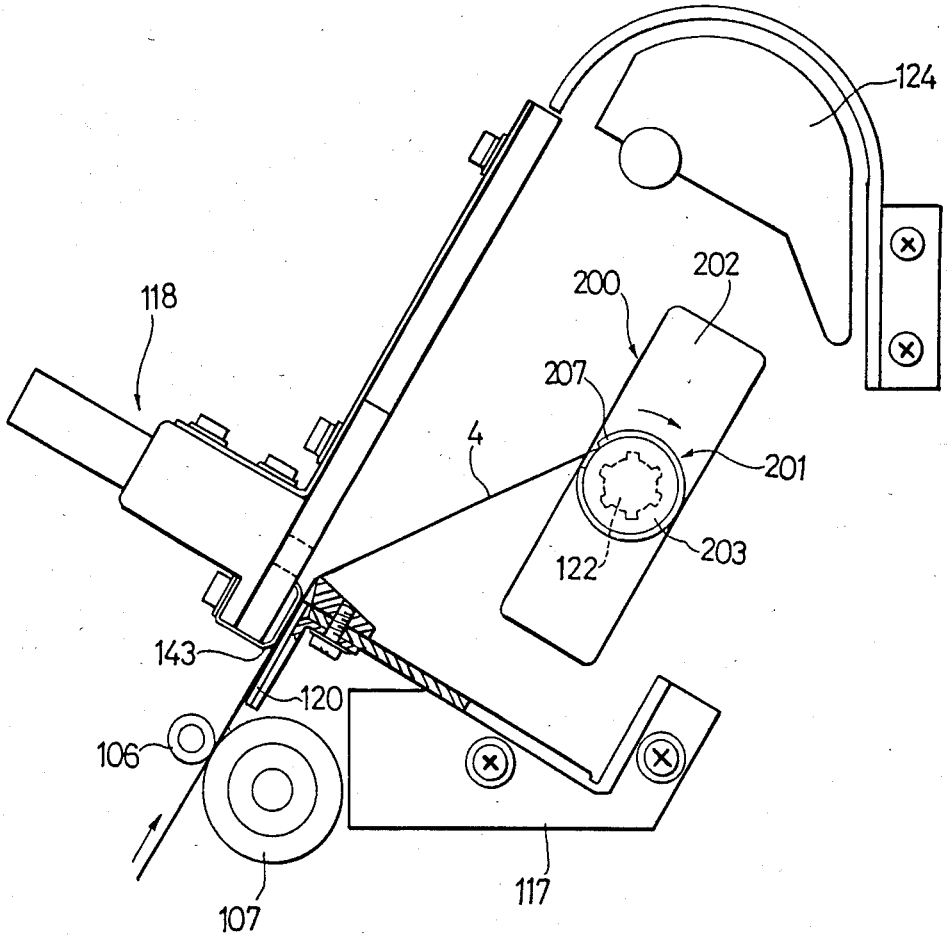
FIG. 22 is a side elevation showing an adaptor mounted in the mounting device to receive the label web.

FIGS. 20 through 22 illustrate another example of use of the present invention in which take-up cassette 1 and label applicator 2 are not used, but printed labels 6 are manually applied to commodities. Specifically, this example utilizes an adaptor 200 and a take-up tool 201, as shown in FIG. 20. Adaptor 200 is constructed such that a cylindrical shaft 203 protrudes from the center of a rectangular base plate 202. Shaft 203 is formed with a blind bore 205 which extends from base plate 202 and has axial grooves 204. Grooves 204 and blind bore 205 are shaped to receive head 122 of rotary shaft 121 of printer 3. Moreover, the axial length of shaft 203 is made larger than the width of the label web 4. Take-up tool 201 is generally of C-shaped cross-section formed by providing the outer circumference of a cylinder with an axial slit 206. Take-up tool 201 is constructed of generally stiff yet flexible material such as metal or plastic. Moreover, take-up tool 201 is made to have an internal diameter slightly smaller than the external diameter of shaft 203 and to have an axial length equal to that of shaft 203.

In use, adaptor 200 is fitted on head 122 of the rotary shaft 121 of printer 3 (FIG. 22). Then, keyboard 146 of printer 3 is used to input the bar codes to be printed. Continuous label web 4 is printed with the bar codes, and the leading end of printed label web 4 is threaded through the gap formed between guide portion 120 and label guide 143. After printed label web 4 is further advanced, keyboard 146 is operated to temporarily interrupt the operations of printer 3.

Next, take-up tool 201 is mounted on the outer circumference of shaft 203 by expanding its internal diameter. Then, take-up tool 201 is held in close contact upon the outer circumference of shaft 203 by its own flexibility. Leading end portion of label web 4 is forced inside of one end portion 207 of take-up tool 201. As a result, that leading end portion is clamped and held between take-up tool 201 and shaft 203. Then, keyboard 146 of printer 3 is operated to restart printer 3, causing adaptor 200 to turn clockwise so that label web 4 is taken up on take-up tool 201.

When a predetermined number of labels 6 have been printed, printer 3 is stopped, and cutter mechanism 118 is actuated to cut the trailing end of label web 4. Then, take-up tool 201 is removed from shaft 203. More specifically, the end portion of take-up tool 201, at the side where the label web 4 is not wound, is gripped and pulled sideways. Then, take-up tool 201 is slid axial on the outer circumference of shaft 203 so that tool 201 is removed from shaft 203 together with printed label web 4 in the rolled shape of FIG. 21. If the outer circumference of take-up tool 201 is pinched by the fingers, as shown in FIG. 21, tool 201 is warped inwardly so that tool 201 can be removed from rolled label web 4. Take-up tool 201 thus removed, may be reused for taking up or winding another length of label web 4 if tool 201 is set on adaptor 200 of the printer 3 and the procedures previously described are repeated.

The aforementioned rolled label web 4 removed from take-up tool 201 is brought to a commodity counter or warehouse, where labels 6 are manually peeled from the backing paper 5 and applied to target commodities.

By utilizing adaptor 200 and take-up tool 201, both having simple constructions, it is easy to wind label web 4 in printer 3. Moreover, take-up tool 201 can be simply extracted by its own flexibility from the rolled label web 4. It is not necessary to use take-up cassette 1 and label applicator 2 in stores which handle a relatively small number of labels.

Thus, it is seen that according to the present invention, merely by mounting a take-up cassette in a printer, the label web having its labels printed with the bar codes can be wound automatically while automating the setting of the backing paper in the bottom of the cassette. This makes it possible to completely automate the label winding and mounting operation which has bottlenecked the development of portable label applying systems. In addition, the label web having been wound up can be cut to have a predetermined length, thereby making it possible to provide an automtic label winding and charging device which has a small number of parts and a simple construction. Further, the operation of mounting and demounting the take-up cassette in and from the printer is simplified to a single action.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A portable label applying system including:

a printer for producing a printed label web by printing a plurality of labels which are adhered in longitudinal series to a web of backing paper;

a take-up cassette adapted to be removably mounted in said printer for receiving the printed label web and also adapted to be removably mounted in a dispenser for removing printed labels from said cassette and applying these printed labels to commodities, said take-up cassette having a first means for generating pressure to hold the backing paper;

an automatic label winding and charging means for use with said printer, comprising:

a cassette guide for guiding said take-up cassette when the latter is to be mounted in said printer, pressure releasing means for releasing the pressure of the first means thereby releasing the backing-paper, label guide means for guiding the printed label web to said cassette, and cutter means for cutting said printed label web;

said pressure releasing means including first and second doors biased to open positions in which they allow said pressure generated by said first means to hold said backing paper, and said doors being operable to closed positions in which they abut the first means to release the pressure of the same while forming a clear passage for said label web.

2. A portable label applying system as set forth in claim 1, wherein said cassette guide member has first and second guide faces intersecting at a right angle for guiding two sides of said take-up cassette.

3. A portable label applying system as set forth in claim 1, wherein said label guide means includes a guide member defining an arcuate guide groove for guiding said label web before the latter enters the cassette.

4. A portable label applying system as set forth in claim 3, further comprising peel preventing means defining said arcuate guide groove together with said guide member for allowing said label web to be guided by said guide member while preventing the labels from being peeled from their backing paper.

5. A portable label applying system as set forth in claim 1, wherein said cutter means includes a stationary knife fixed to said cassette guide member, and a movable knife hinged and biased away from said stationary knife for cutting said label web when said movable knife is operated manually toward said stationary knife.

6. A portable label applying system as set forth in claim 1 in which the firsrt and second doors are operable to said closed positions after said cassette is seated by said cassette guide.

7. A portable label applying system as set forth in claim 1 in which said cassette when mounted in said printer receives the printed label web through said passage.

8. A portable label applying system as set forth in claim 7 in which the first and second doors are operable to said closed positions after said cassette is seated by said cassette guide.

* * * * *